US007037033B1

(12) United States Patent
Attar

(10) Patent No.: US 7,037,033 B1
(45) Date of Patent: May 2, 2006

(54) PROCESS OF MANUFACTURING ONE-PIECE REFLECTIVE PAVEMENT MARKER AND METHOD OF MAKING

(76) Inventor: Adil H. Attar, P.O. Box 3883, Ont., CA (US) 91761

( * ) Notice: Subject to any disclaimer, the term of this patent is extended or adjusted under 35 U.S.C. 154(b) by 0 days.

(21) Appl. No.: 10/644,496

(22) Filed: Aug. 20, 2003

Related U.S. Application Data

(60) Division of application No. 09/634,430, filed on Aug. 8, 2000, now Pat. No. 6,698,972, and a continuation-in-part of application No. 09/880,780, filed on Jun. 13, 2001, which is a continuation-in-part of application No. PCT/US00/22449, filed on Aug. 15, 2000.

(51) Int. Cl.
*E01F 11/00* (2006.01)

(52) U.S. Cl. ..... 404/15; 404/16; 404/12

(58) Field of Classification Search ..... 404/12–16
See application file for complete search history.

(56) References Cited

U.S. PATENT DOCUMENTS 3,785,719 A * 1/1974 Jonnes ..... 359/538
3,879,148 A * 4/1975 Eigenmann ..... 404/10
3,971,623 A * 7/1976 Hedgewick et al. ..... 359/531
4,145,152 A * 3/1979 Waugh ..... 404/71
4,221,498 A * 9/1980 Schueler et al. ..... 404/9
5,267,809 A * 12/1993 Allan ..... 404/14
5,310,279 A * 5/1994 Lindner ..... 404/14
5,393,166 A * 2/1995 Stock et al. ..... 404/14
5,460,115 A * 10/1995 Speer et al. ..... 116/63 P
6,505,994 B1 * 1/2003 Attar ..... 404/16

* cited by examiner

*Primary Examiner*—Raymond W. Addie

(57) ABSTRACT

A reflective pavement marker is used for delineating roadways, having at least one retro-reflective face, including a plurality of cube-corner reflective elements. The marker may comprise two similar portions agglutinated to each other along a vertical back wall of each marker and along an upper resilient segment, such as a handle bar, having beaded periphery edges, that facilitate agglutinating one marker to another, to form a bi-directional pavement marker. An abrasion-resistant, coating can be provided upon the reflective surfaces of said marker. The marker can be made from abrasion and ultra violet radiation resistant polymers, in either single or dual color segments.

5 Claims, 8 Drawing Sheets

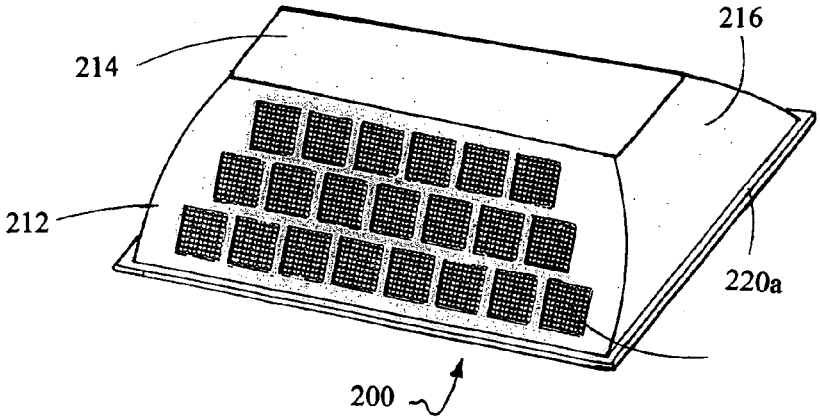
FIG.1
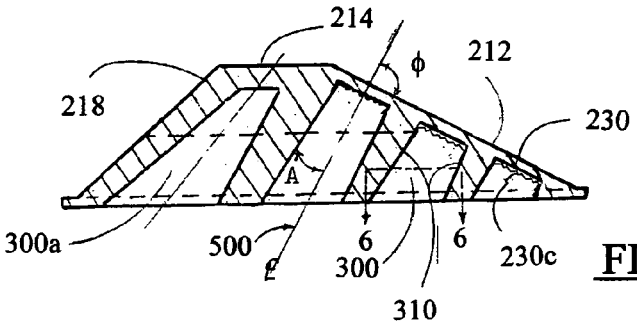
FIG.4
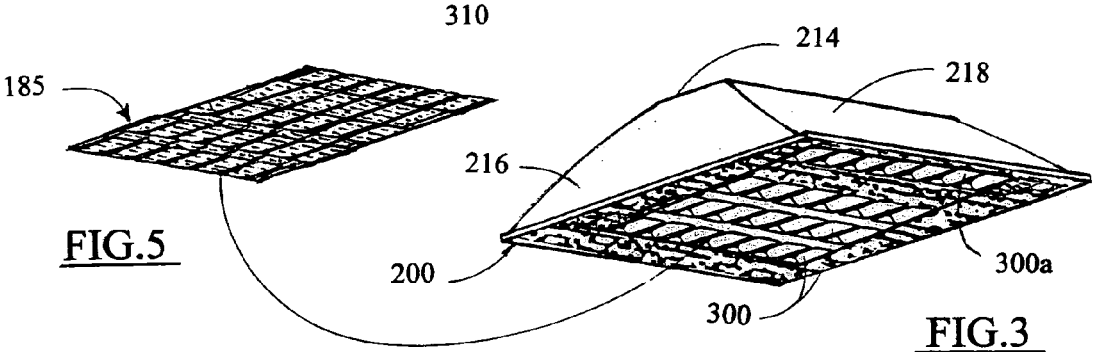
FIG.5
FIG.3
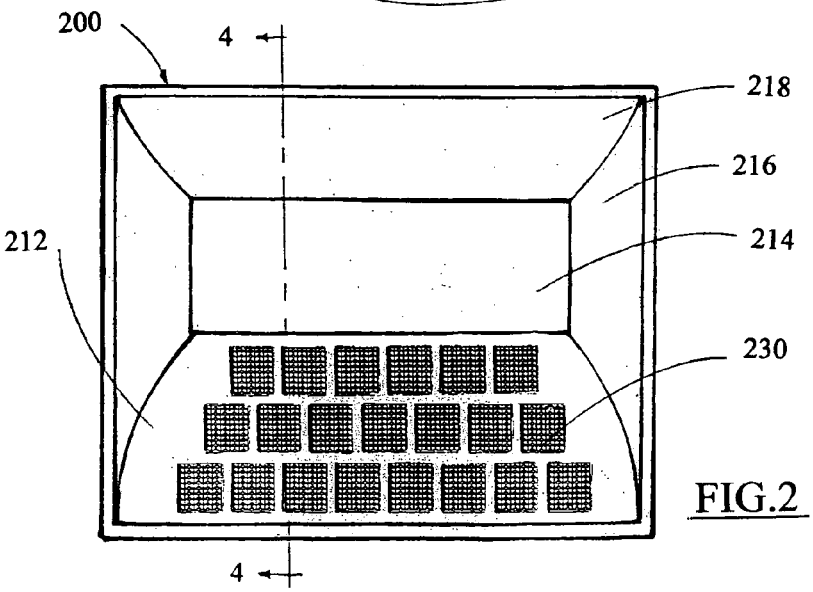
FIG.2
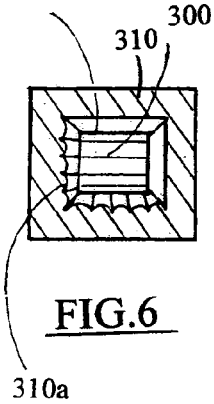
FIG.6

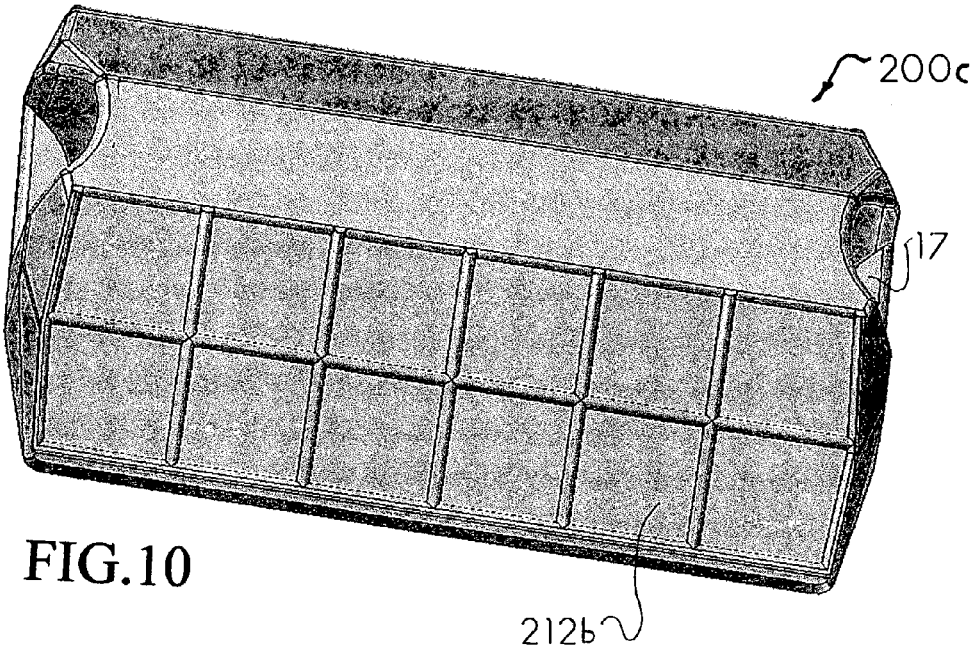
FIG.10
FIG.11
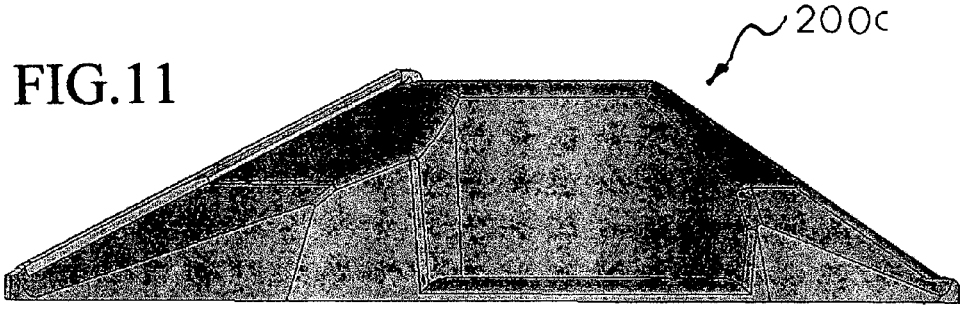
FIG.12
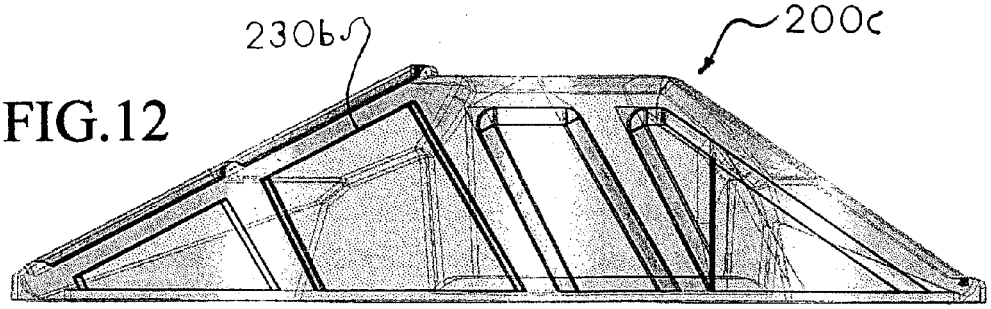

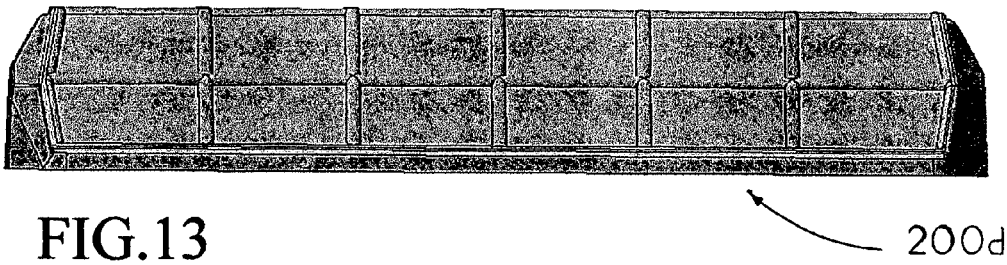
FIG.13
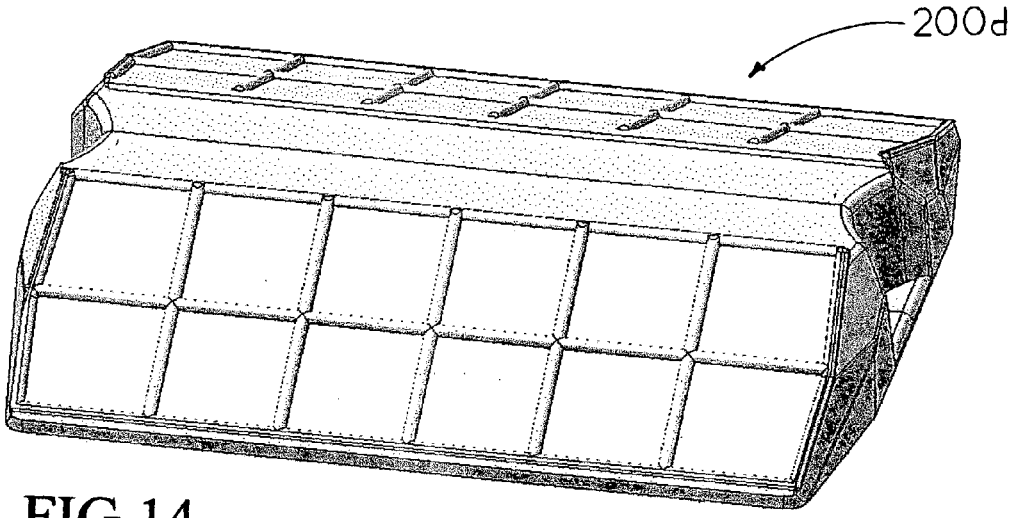
FIG.14
FIG.14b
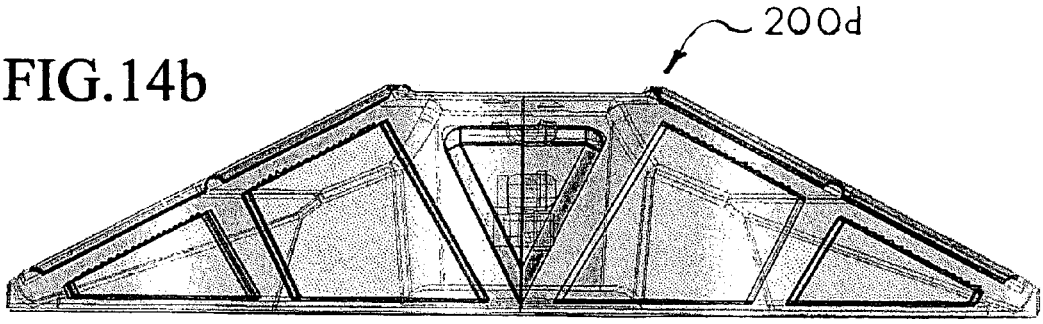

PROCESS OF MANUFACTURING ONE-PIECE REFLECTIVE PAVEMENT MARKER AND METHOD OF MAKING

CROSS REFERENCE TO RELATED APPLICATIONS

This is a Divisional of application Ser. No. 09/634,430 filed Aug. 8, 2000; now U.S. Pat. No. 6,698,972 and is a continuation in part of Ser. No. 09/880,780 filed Ser. No. 09/880,780 filed Jun. 13, 2001; which is a continuation in part of PCT/US00/22449 Aug. 15, 2000.

BACKGROUND OF THE INVENTION

1. Field of Invention

This invention relates to the process of forming roadway markers that are used for traffic lane delineation, in particular, to markers used as lane divider with enhanced reflectivity and abrasion resistant.

2. Related Art

Roadway markers are adhered to pavements along centerlines, edge lines, lane dividers or guardrail delineators. Other roadway markers are used as temporary lane dividers in temporary constructions, detours or prior to permanent marking of newly paved roadways. Since 1965, the most commonly used retroreflective roadway markers are based on Heenan U.S. Pat. No. 3,332,327, Balint U.S. Pat. No. 3,409,344, or Edouart U.S. Pat. No. 4,991,994. Typically, this type of markers are produced in a process consisting of three to five steps: Firstly, injection molding of a thermoplastic shell, either integrally molded with the reflective face, or the reflective faces welded on a corresponding open recesses within the shell. The reflective face, having about 350 or more cube corner reflective elements on each reflective face of the shell. Secondly, either the reflective faces within a shell or the entire inside surface of the shell coated with a reflective metallic sealer by a process known as vacuum metalizing.

This metallic sealer needed to seal the cube corner reflective elements so they retain part of their retroreflectivness prior to the next step of filling the shell with a thermosetting resinous material, such as epoxy or polyurethane.

This resinous filler material encapsulate the metalized cube corner reflective elements and give the marker the structural body. Finally, a layer of relatively course sand or glass beads dispersed over the top surface of the filler material prior to solidification of the filler material. This top surface will be the marker's base. Part of the sand particles will remain partially protruding above this planar surface of the marker base, thereby increase the adhesive welding parameter of the base surface. The protruded sand will improve adhesion to substrate, regardless of the type of adhesive used. This type of markers worked well for six or seven months, however, due to poor abrasion and impact resistant of the thermoplastic shell, over 60% of the reflectivity lost thereafter. Also, incompatibility of the shell material to the resinous filler material causes pealing of the reflective face or the shell, thereby losing retroreflectivity. Several attempt were made to improve abrasion resistant of the reflective face.

One was the use of thin layer of untempered glass as disclosed in U.S. Pat. No. 4,340,319, another attempt was the use of polymeric coating of the reflective face, as disclosed in U.S. Pat. No. 4,753,548 to (Forrer). These abrasion resistant coating proving to be expensive and tend to reduce retro reflectivity. Other major development in the pavement marker art has been made, this was achieved by eliminate the use of the metalized sealer for the cube corner reflective elements. By dividing the inside surface of the reflective face into reflective cells, each cell will have several cube corner reflective elements, the cells isolated from each other by partition and load carrying walls. The reflective faces welded to corresponding recesses within a hollowed body.

This method is disclosed in U.S. Pat. No. 4,227,772 (Heenan); U.S. Pat. No. 4,232,979; and U.S. Pat. No. 4,340,319 (Johnson et al); U.S. Pat. No. 4,498,733 (Flanagan). These markers proved to be superior in reflectivity, however, lack of structural strength and poor adhesion cause short life cycle for this type of markers. This applicant successfully developed two multi-cell reflective roadway markers. One roadway marker utilizes raised rhombic shaped abrasion reducing and load transferring raised ridges, said ridges intercede abrasion elements and impact load. The shell filled with epoxy, hence, the marker body having a base with large wetting parameter for shear and flexural strength, as disclosed in U.S. Pat. No. 4,726,706. The second roadway marker of this applicant, U.S. Pat. No. 5,927,897 developed a mean to increase the abrasion resistant of the reflective face by coating the reflective face with diamond-like film and by having holding pins extending from the partition walls into the body, the holding pins sealed by the filler material; this works very effectively. The entire above reflective pavement markers are incorporated herein by reference in their entireties. The present goal of Applicant is to have a durable roadway marker with high reflectance, abrasion resistant, low cost, marker base area with good welding parameter and one-step process to manufacture said reflective pavement marker.

SUMMARY OF THE INVENTION

This invention provide a novel process of forming one piece raised roadway marker or delineator that comprises a monolithically injection molding the structural body with one or two reflective faces and a base having large area for adhesive welding parameter, thereby provide better adhesion to the pavement and higher resistance to flexural stresses.

The primary objective of this invention is to provide one-step process of manufacturing reflective pavement markers or delineators, while retaining maximum reflectivity and structural strength. Another objective of this invention is to provide a raised roadway marker made of high impact resistant material and abrasion resistant surface with high reflective index.

The present invention further provide a method of making one piece raised roadway marker of any desirable shape and configuration, such as, a marker with truncated body or one piece delineator with two vertically positioned reflective faces, with means to include cube corner reflective elements on the interior of said faces, and having grooved planar base surface.

In accordance with still further aspect of this invention, the marker can be made for one or two way traffic usage; having integrally built-in reflective faces provides durability and cost effectiveness. Also two multi colored parts can be welded together to form multi colored reflective pavement marker. resistance thermoplastics. The integrally formed reflective face provided with means to form cube-corner reflective elements on designated cell like areas within the inside surface of said reflective face. The reflective pavement marker further provided with means to enhance abrasion resistant surface.

BRIEF DESCRIPTION OF THE DRAWINGS

The advantages and unique features of this invention will be better understood by reference to the drawings. These drawings are schematics, no scale used. In the drawings:

FIG. 1 is an isometric view of a preferred one-piece pavement marker of the invention;

FIG. 2 is a plan view of the pavement marker illustrated in FIG. 1;

FIG. 3 is another isometric view of marker in FIG. 1 showing the base portion showing the hollow cavities ends;

FIG. 4 is a cross section view taken along the line 4—4 in FIG. 2;

FIG. 5 is an isometric view of a thin plate that can be used to seal the ends of hollow recesses;

FIG. 6 is a section view along line 6—6 in FIG. 4 showing partly grooved surfaces of a hollow cavity;

FIGS. 10 to 12 show isometric and side views of yet another preferred geometry of a one-piece marker;

FIGS. 13 to 14*b* show an isometric and transparent side views of a one-piece pavement marker with two reflective faces;

DESCRIPTION OF THE PREFERRED EMBODIMENTS

Figure 7:
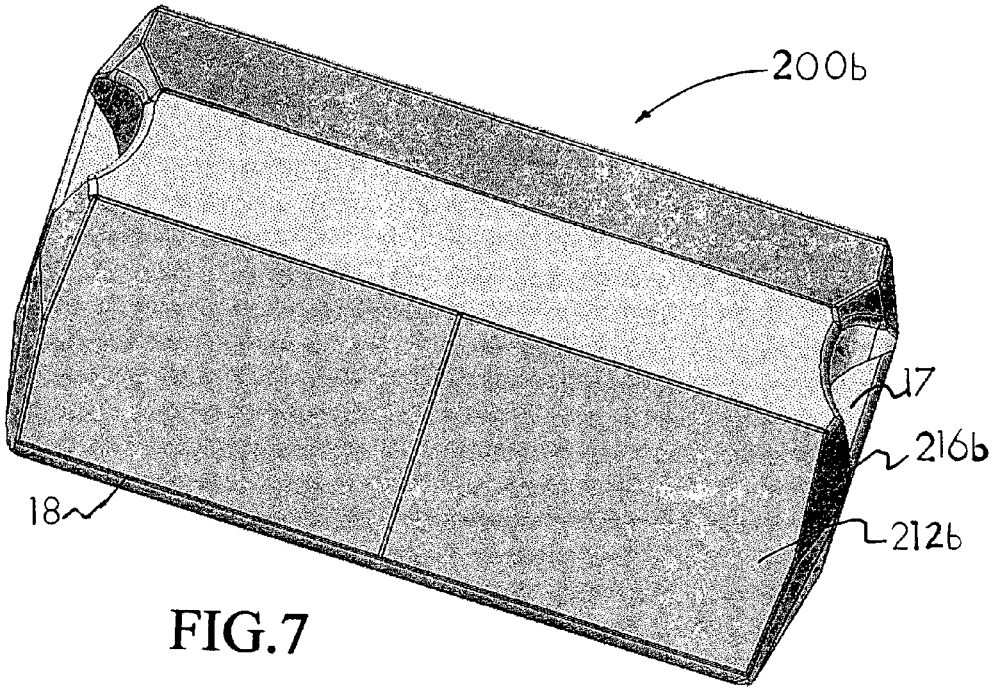
FIGS. 7 to 9 show isometric, side and transparent side views of a preferred geometry for the one-piece marker of the present invention.
Figure 8:
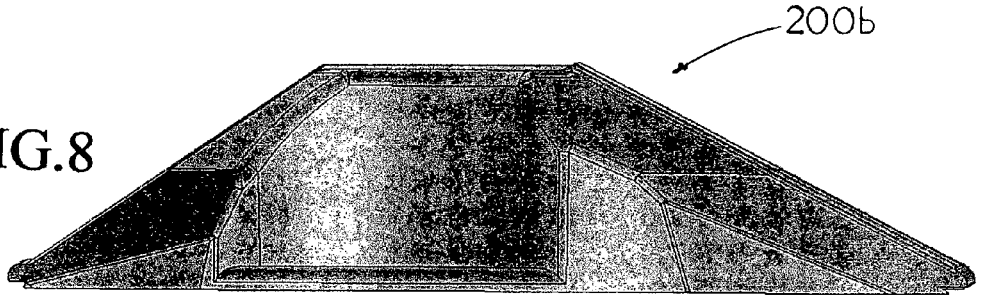
Figure 9:
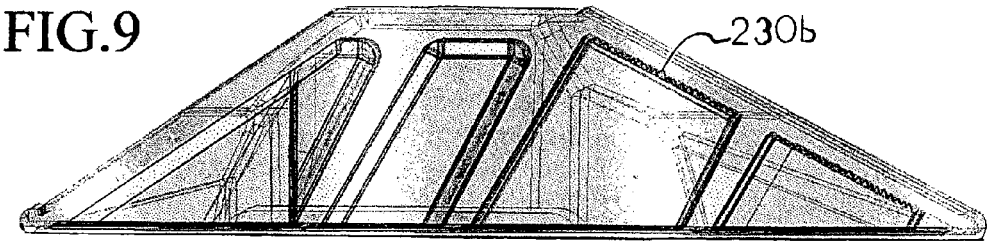

Enhanced reflectivity, durability, cost effectiveness and simplified production method can be achieved by eliminating major steps or processes used in previous arts for manufacturing reflective pavement markers. This invention is satisfying the above conditions.

This invention eliminate the process of metalizing the reflective face, eliminate the step of welding a backing sheet or a lens mounting sheet to the reflective face; eliminate filing the marker body (shell) with inert filler or resinous material.

This invention is a process for monolithically forming a reflective pavement marker in one-stage or two-stage injection molding cycle. This process comprises a mold that provide the means to form an entire reflective marker monolithically including a structural body, cube corner reflective elements as well as load carrying interior walls.

Referring to FIGS. 1 through 6 represent one of the preferred embodiment of a monolithically formed one-piece reflective pavement marker designated by the number 200.

Marker 200 comprises, a top portion 214, two arcuate sides 216, two inclined planar faces 218 and 212 that are facing opposing traffics, with at least one face (212) is provided with means to integrally include cube corner reflective elements 230*c* on designated cell like areas 230 within the inside surface of said face 212. Marker 200 also integrally includes textured and grooved planar base surface 220 with extended base portion 220*a* for added adhesion area. Various types, sizes or shapes of cube corner reflective elements can be utilized in this process of monolithically forming marker 200.

Preferably, the height of each cube corner reflective element is about 0.0035 to 0.0625 inches. The inclined planar reflective face 212 integrally has the interior cell like surfaces 230 defined by load carrying interior walls 310, which provide air gaps 300 beneath the cube corner reflective elements 230*c*.

Reflective cells 230 can be of any desired shape or size depending on the positions and shapes of the load carrying interior walls 310. Various reflective cell shapes and cube-corner reflective element sizes can be formed utilizing the method of the present invention. FIG. 35 thru FIG. 37 shows few preferred reflective cells with various types of micro prisms that can be used.

The following U.S. patents provide suitable exterior body shape, cell and cube corner element designs. All of the following arts are incorporated as reference in their entireties: U.S. Pat. Nos.

4,726,706 and 5,927,897 to Attar and U.S. Pat. No. 3,712,706 to Stam.

Interior cells 230 are defined by load carrying interior walls 310. The angular positions of these walls 310 provide the unobstructed ejection direction for injection molding of the protruding, three dimensional cube corner reflective elements 230*c* as integral part of the structural body of said marker 200. The reflective elements 230*c* within each interior cell 230 are isolated from adjacent cells by said load carrying interior walls 310, said interior walls 310 are tapered outwardly, thereby defining multiple hollow cavity air gaps 300. Each hollow cavity air gap 300 is formed corresponding to the size and interior shape of cell like surfaces 230. Hollow cavity air gaps 300 are integrally defined with their centerlines 500 forming an angle ($\phi$) of about 80 to 120 degrees with respect to the outside planar surface of reflective face 212. The load carrying interior walls 310 are tapered forming an angle (A) of about 2 to 5 degrees with respect to each hollow cavity centerline 500.

Hollow cavities 300*a* are used when the desired marker is to have only one reflective face. Both hollow cavities 300 and 300*a* will be tapered outwardly and open through the textured and grooved planar base surface 220. The load carrying interior walls 310 defining hollow cavities 300 and 300*a* can have fillet corners.

Part of the interior surfaces of load carrying walls 310 and the interior surfaces of planar top portion 214 can be formed with textured arcuate grooves 310*a*, as in FIG. 6, for added reflectivity, surface opaqueness, and enhancing daytime appearance.

Marker 200 can be manufactured utilizing an injection molding process, either in one stage or two-stage color injection molding cycles. Various transparent, high impact resistance polymeric material are readily available for forming such markers.

FIG. 7 thru 14*b* show variations in surface geometry of vet another preferred one-piece markers 200*b*, 200*c* having one reflective face and marker 200*d* with two opposing reflective faces. Marker 200*b*, 200*c* and 200*d* essentially have similar inclined reflective faces 212*b*, each with two rows of reflective cells 230*b*, two multi angled sides 216*b* each with grip regions 17.

Each reflective cell 230*b* integrally having multiple cube corner reflective elements on the inside surface within defined hollow cavities.

The outside surface of reflective face 212*b* can integrally have periphery with slightly raised bumper 18, as in marker 200*b* or can have every reflective cell 230*b* have an outside surface defined by bumpers 18, as shown in marker 200*c* and 200*d*.

Marker 200*b*, 200*c* and 200*d* can be formed effectively by means of an injection-molding machine with multi-color dispensing, utilizing a precision mold with two separate material entries apertures.

This multi-colored injection-molding process will provide the means to form the transparent reflective cells 230*b* and simultaneously inject an opaque colored resinous material filling remaining body portion of marker 200*b*, 200*c* or 200*d*.

An alternative and inexpensive process of forming a multi colored, one-piece marker 200*b*, 200*c* or 200*d* can be achieved by using an injection-molding machine with one color injection process. This one color process can be used to firstly form a transparent, one color reflective marker 200*b* or 200*c*, using a low cost mold.

In a second step, the outside surface of the reflective face 212*b* is coated with a highly abrasive resistant resinous film like material. The hard topcoat allowed to be partially cured.

In a third step means can be provided for applying an abrasive resistant, resinous opaque color coat to the remaining body portion. This resinous color coat can be formulated from similar or compatible hard polymeric coating material. This hard resinous coat can be formulated with any opaque or transparent color additive.

Several readily available, low cost alkyl acrylate, alkyl methacrylate or mixture thereof can be used as abrasion resistant topcoat. This type of resin coating is suitable for use on the marker outside surface to enhance abrasion resistance properties or to provide partial opaque colored body surface. This type of resin coating can be applied as a hard, transparent, protective coating for the reflective face 212*b* of the markers as well as using colored portion of the same resinous coating material on the remaining surface regions of the marker body.

This topcoat can be achieved either through dip coating, spray coating or brushing the desired surface portions.

Such hard coat film can be cured at ambient temperature or accelerated slightly using UV heating. When opaque color additive is blended with this type of hard resinous material, the colored mixture can be used to seal the remaining transparent body portions of markers 200*b*, 200*c* and 200*d*. This hard, colored topcoat will provide the same abrasive resistant, durable surface. One color or two opaque color segments can be applied to the body of the marker in addition to retaining a transparent reflective faces 212*b*.

Generally, for dip coating or spray coating a resinous coating material, the base resin is selected from a variety of resins such as polysiloxane, alkyl acrylate, ceramic, and other silicone coating composition. Melamine resin or colloidal silica is used as cross-linking agent. Other resinous, polymeric materials are continuously being custom formulated that can be utilized as well. Various additives such as hardener, accelerator, U.V. stabilizer, color additive and other wetting agents may be added to enhance such coating resins.

Various formulations can be readily attained for a highly abrasive and UV resistant topcoat. Detailed descriptions of some suitable resin coating compositions are provided in U.S. Pat. No. 4,455,205 to Olson, U.S. Pat. No. 4,374,164 to Blank, U.S. Pat. No. 4,486,504 to Chung, U.S. Pat. No. 4,526,920 to Sakashita, U.S. Pat. No. 4,420,597 to Fekete and U.S. Pat. No. 5,648,173 to Blizzard This method of hard surface coating and opaqueing markers 200*b*, 200*c* and 200*d* exterior surfaces is preferred when a low coast operation and low investment on equipments and tooling are desired. The open ends of the hollow cavities at the base surface is sealed by agglutinating or sonic welding a compatible sheet of about 0.020 to 0.08 inch thick to designated regions within the base surface. This open base area sealing process can be achieved either as a second step or as a fourth step after the opaque hard coat is applied. The base sealing process can use a continuous or semi continuous means. An appropriate size sheet is advanced to a position beneath the marker, welded and trimmed simultaneously.

A simple and efficient injection molding process for molding markers 200, 200*b*, 200*c* and 200*d* can be achieved, by setting the mold's X-axis to be parallel to the planar reflective face 212 or 212*b*, thereby allowing all centerlines of the interior hollow cavity air gaps to be closely aligned with respect to the Y-axis of said mold.

The y-axis corresponds to the open and close direction of said mold.

In order to allow easy ejection cycle during injection molding process of markers 200, 200*b*, 200*c* or marker 200*d*, a small, outwardly draft angle is usually provided for the tapered surfaces of the load carrying interior walls, thereby providing said uninterrupted injection molding cycles. The same method for manufacturing the one-piece markers 200, 200*b*, 200*c* and 200*d* can be used to effectively manufacture any desired pavement marker with a commonly used exterior geometry. When using the multi-colored, injection molding process, two or more liquefied polymeric materials are heated, liquefied separately and preferably enter the mold through two independent apertures. These entry apertures are located on a portion of the mold forming the base, sides or top surfaces of the pavement marker core or cavity mold portions.

Thermoplastic such as high impact resistance acrylic, polycarbonate, ABS or any other compatible, high impact resistance polymers are suitable to be used either singularly or injected simultaneously after a compatible transparent polymer is first injected to fill the reflective face portions of the mold forming the marker.

Reflective face 212 or 212*b* can have either three raw, two raw or one raw of reflective cells, depending on the desired size, shape or height of the one-piece markers and the reflective cells being used in this process.

The depth of textured grooves at the base surface preferably about 0.01 to 0.05 inches. Part of the tooling mold is sand blasted to achieve a textured surface. In addition, planar base surface 220 can have an integrally extended portion 220*a*, which extends beyond the periphery of marker body for added adhesive grip.

FIG. 28 through 30 show another reflective marker 15 that can be fabricated in accordance to the process of present invention. Marker 15 can have two reflective faces 14, each with integrally formed, multiple reflective cells 14*a*. Each of cells 14*a* integrally having multiple of micro size cube corner reflective elements. The hollow cavity air gaps are defined within load carrying partition walls 14*b* and directly beneath each reflective cells 14*a*.

The centerline of each hollow cavity is near perpendicular to the planar base surface 16.

Various sizes of the reflective micro cube corner elements can be used. A preferred type of such micro cube corners is described in U.S. Pat. No. 3,712,706 to Stamm incorporated herein by reference in its entirety.

This type of reflective elements would minimize any ejection problems during the process of injection molding marker 15.

Figure 27:
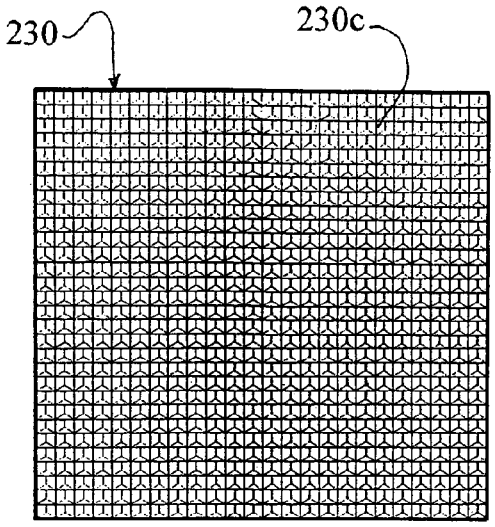
FIG. 27 is plan view of a rectangular reflective cell showing multiple micro cube corner reflective elements.
Figure 25:
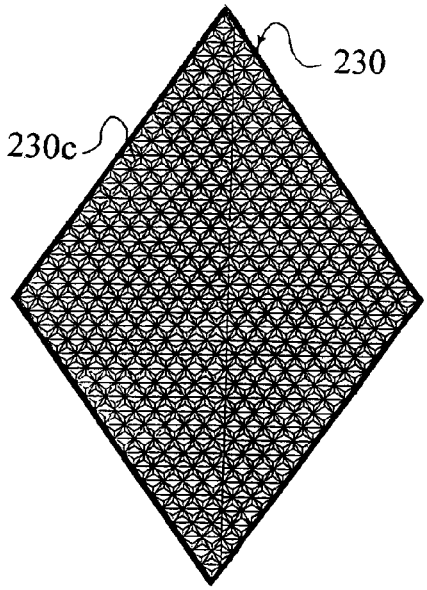
FIG. 25 is another preferred rhombic shaped reflective cell with deferent micro reflective elements
Figure 26:
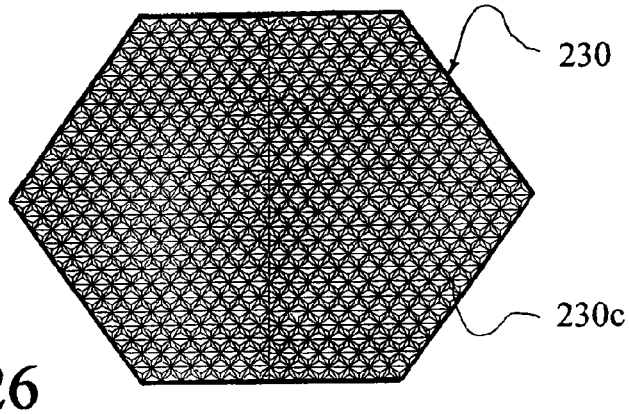
FIG. 26 is yet another shape of a reflective cell that can be used for markers of the present invention.

FIG. 25 through 27 shows various reflective cell shapes and sizes of cube corner reflective elements.

Figure 20:
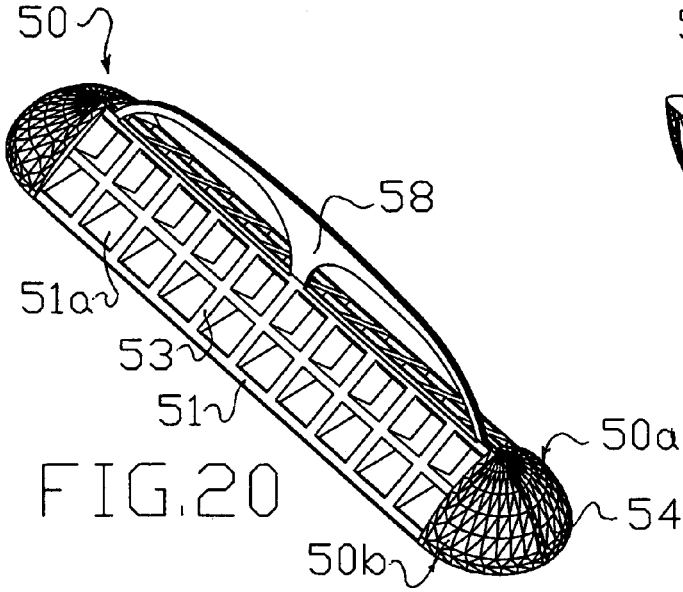
FIG. 20 is isometric view of a dual use delineator-temporary marker as per this invention.
Figure 21:
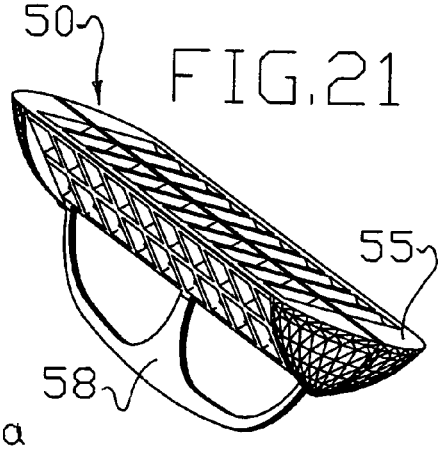
FIG. 21 is another isometric view of marker in FIG. 20 showing the base surface.

FIGS. 20 through 24 illustrate yet another novel structure that can be manufactured using the means in accordance to the processes of the present invention. In FIG. 20, there is shown a preferred embodiment of a temporary roadway marker 50 integrally formed in accordance to the present invention.

Temporary marker 50 can be integrally formed by injection molding the two sides 50*a* and 50*b* identical to each other.

Each side is having an upper segment 58 that resemble a handle bar, which will be called handle bar 58, and a lower body segment 52.

Body 52 is having two arcuate sides 54, an inclined planar reflective face 51 with two rows of multiple reflective cell like areas 51*a* on its interior surface. The two rows of cell like interior areas 51*a* are integrally include multiple cube corner reflective elements. The interior surfaces of cells 51*a* are open within hollow cavity air gaps 56 and 56*b* defined by means of load carrying partition walls 53. Body 52 also integrally includes a backside 57 with beading means for sonically welding the opposing sides 50*a* and 50*b*, thereby forming temporary marker 50. The two nearly identical sides 50*a* and 50*b* can be separately injection molded and welded together. Alternatively, both can be injection molded with integral tie segments.

Figure 24:
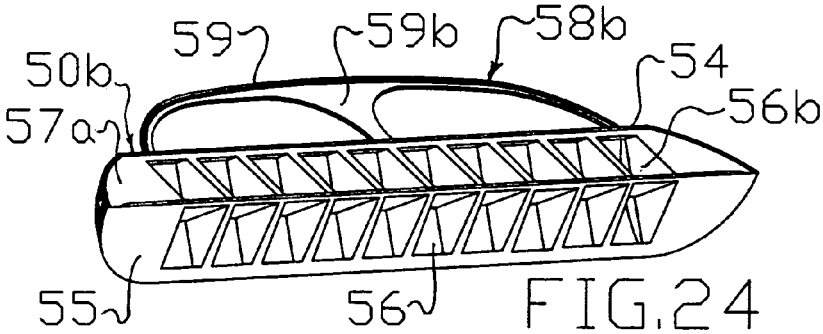
FIG. 24 is an isometric view of one side of delineator of FIG. 20, showing the backside.

FIG. 24 shows an isometric view of one side 50*b* of temporary marker 50, illustrating the planar base surface 55, integrally including one row of multiple hollow cavities 56. Hollow cavities 56 are open directly beneath the lower row of reflective cells 51*a*, thereby providing ejection means during the injection molding of cube corner reflective elements as an integral part of the interior of said lower row of cells 51*a*. Also shown in FIG. 24 a back portion 57*a* of side 50*a* and the upper handle bar back side 58*b* defined by periphery beads 59.

Back portion 57*a* is having textured planar surface that can be provided with beads or raised ridgelines for welding purposes.

Each side also includes a second row of hollow cavity air gaps 56*b*. Hollow cavities 56*b* are open directly beneath the upper row of reflective cells 51*a*, thereby providing the means which allow integrally forming multiple of cube corner reflective elements on the inside surfaces of said upper row of cells 51*a*.

Back portion 58*b* can also be provided with means to integrally forming multiple of cube corner reflective elements bounded by raised periphery edges 59. Periphery edges 59 provide means to weld and seal the two sides of handle bar 58. The out side planar surfaces of cells 51*a* can be either planar part of the inclined planar face 51, or formed slightly recessed bellow the outside planar inclined face.

When the two sides 50*a* and 50*b* are sonically welded fusing the textured or beaded backsides, an air gaps will be retained, both in the upper handle bar 58 and the lower body 52, thereby allowing retro reflectivity, both from the handle bar segment and from the lower body segment, and on two opposing traffic paths.

Figure 23:
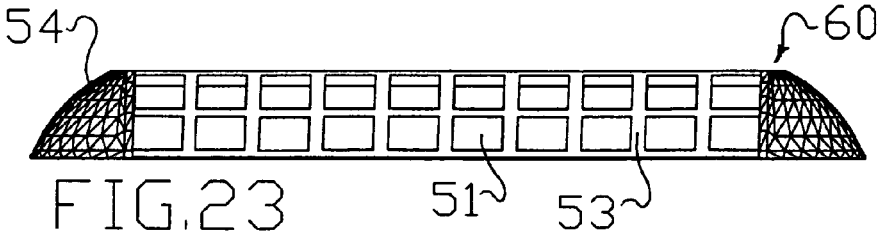
FIG. 23 is an elevation view of delineator of FIG. 20 without the top portion.

Both, the handle bar segments 58 and the lower body 52 can be integrally formed from highly transparent and resilient plastic. Temporary marker 50 can also be injection molded without the handle bar segment 58 and with a multi colored body, thereby forming a low profiled mini reflective marker with a height of about 0.4 to 0.5 inch and an inclined planar face 51 forming an angle of about 28 to 45 degrees with respect to the base surface 55, as shown in FIG. 23 with a designated temporary marker number 60. Handle bar 58 can have a tear able type of connection with the lower body portion 52.

The one-piece reflective marker of this invention can have a height of about 0.40 to 0.75 inches, with a base having a width of about 4.0 to 5.0 inches and depth of about 2.0 to 4.0 inches.

Figure 15:
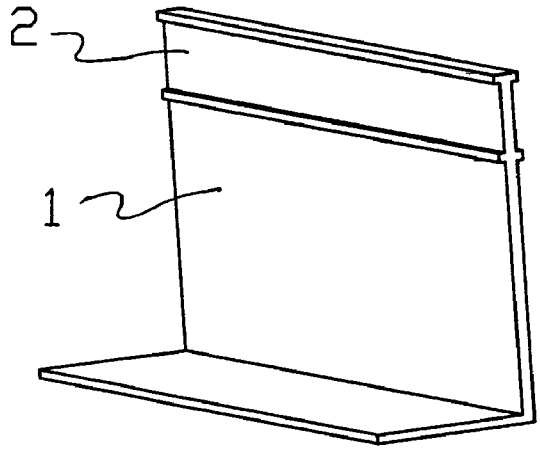
FIG.15 [Prior Art]
FIG. 15 (FIG. Prior Art 15) is an isometric view of conventional slurry seal delineator.

FIG. 15 (Prior Art 15) illustrates a schematic view of a typical L shaped delineator. This delineator made having either extruded or injection molded body 1, and two reflective strips 2 attachments, each with multiple cube corner reflective elements, said strips 2 adhered onto the top part of said body.

Figure 16:
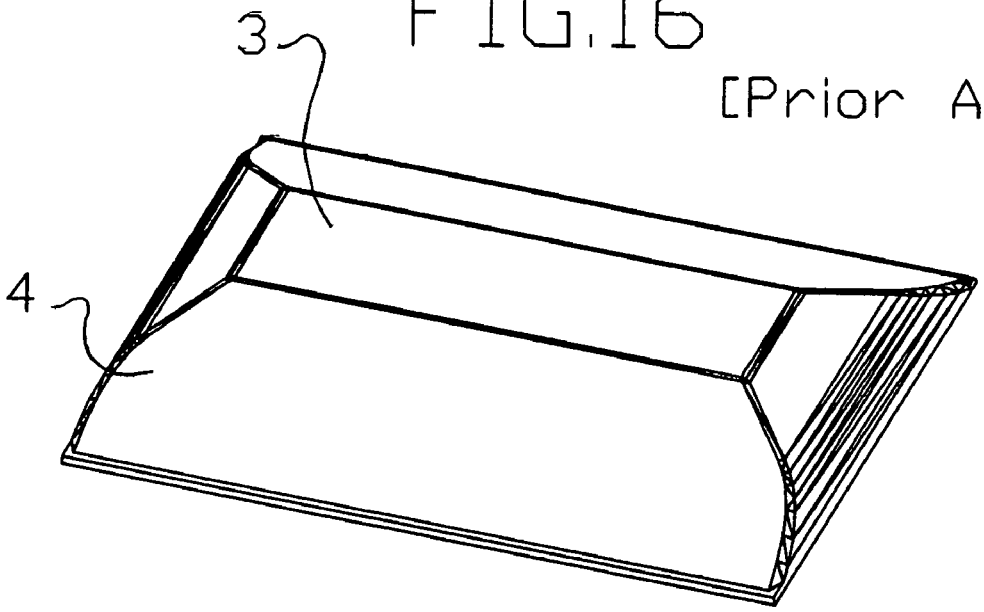
FIG.16 [Prior Art]
FIG. 16 (FIG. Prior Art 16) is schematic view of a temporary pavement marker.

FIG. 16 (Prior Art 16) illustrates another delineator or temporary marker. This type of temporary marker is usually made of two parts, a body with multiple of hollow cavities 3, and at least one reflective plate attachment 4.

The process of the present invention can provide the means for integrally forming the entire delineator or temporary roadway marker's structural body including the cube corner reflective elements in one single injection molding cycle. Such delineator or temporary roadway marker made of one or two colored, high impact and tear resistant thermoplastics. This type of delineator can also be integrally formed from two compatible polymeric materials.

At least the reflective face portion integrally made of optically clear thermoplastic, including the cube corner reflective elements.

The illustrated embodiments in FIGS. 17 through 24 exemplify few delineators and temporary markers that can be manufactured according to the process of present invention.

Figure 17:
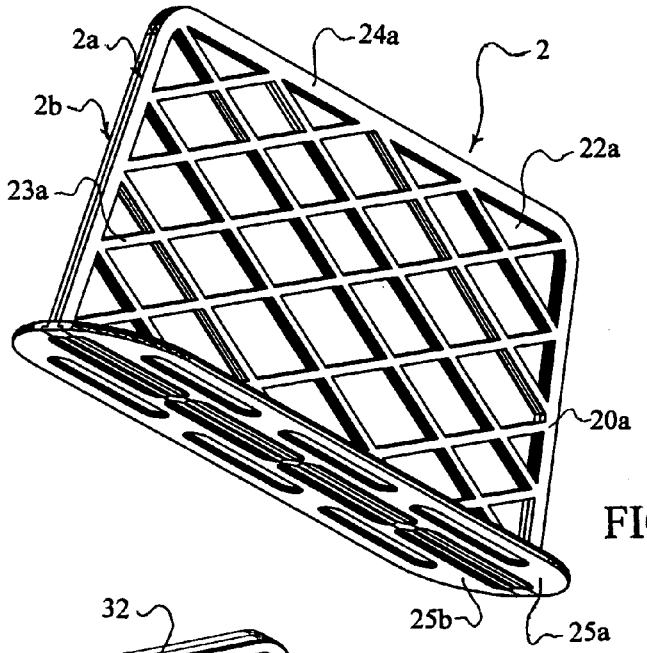
FIG. 17 is an isometric view of preferred delineator made in accordance to the invention.

FIGS. 17 and 17*b* show one of the preferred embodiments of a delineator 2. FIG. 17*b* in particular shows the two sides 2*a* and 2*b* of delineator 2, within the proximity of their position while being ejected during the injection molding process of said delineator 2. Each side 2*a* comprises a planar base portion 25*a* with recessed grooves and a vertically positioned reflective face portion 20*a*. Base portion 25*a* is planar and can have few holes pierced through its surface for better agglutination. The base surface is near perpendicular to face portion 20*a*. Face portion 20*a* is having two distinct sides, an interior side and exterior side. Both sides of face portion 20*a* are integrally partitioned into two or more cell like shapes 22*a*. Cells 22*a* having an outside planar surfaces, said planar exterior surfaces separated from each other by raised partition walls 23*a*.

Cells 22*a* have interior surface integrally formed with multiple cube corner reflective elements. The interior surfaces of the cells 22*a* are isolated from each other by the interior extension of partition walls 23*a*. Interior walls 23*a* having wedge shaped top segment which allow sonic welding the corresponding walls of the delineator's opposing side 2*b*.

Both side 2*a* and 2*b* can be formed having periphery walls 24*a* defining the face portion 20*a*, and providing means to interlock with the corresponding periphery walls on the integrally formed opposite side 2*b*. Periphery walls 24*a* can also be integrally formed with textures or beads on its inside surface to partially fuse with said opposite walls on side 2*b* of delineator 2.

Sides 2*a* and 2*b* can be either integrally injection molded with wedge shaped ties 28, said ties 28 can be folded or split apart, thereby allowing the two sides 2*a* and 2*b* to interlock or be sonically welded to each others interior side.

Alternatively, the two sides can be identical parts that can be injection molded individually. In a second step welded together forming delineator 2.

After the two sides 2*a* and 2*b* are interlocked or welded, air gaps will be retained between the inside surfaces of each two opposing cells 22*a*, thereby allowing maximum retro reflectivity on two opposing traffic paths, via the freely protruding cube corner reflective elements within the interior surfaces of said cells 22*a* of sides 2*a* and 2*b*.

Various types of interlocking means, welding methods, and types of cube corner reflective elements and method of forming the same are available and can be incorporated in the process of forming delineators or temporary roadway markers or snow plowable inserts, in accordance to the present invention.

Descriptions of suitable cube corner reflective elements are provided in U.S. Pat. No. 3,712,706 to Stamm; U.S. Pat. No. 3,922,065 to Schultz; and U.S. Pat. No. 4,588,258 to hoopman, all of which are incorporated herein by reference in their entireties.

Any desired marker size or geometric shapes of each reflective cell can be incorporated in the injection molding process of forming the marker in accordance to present invention.

Figure 18:
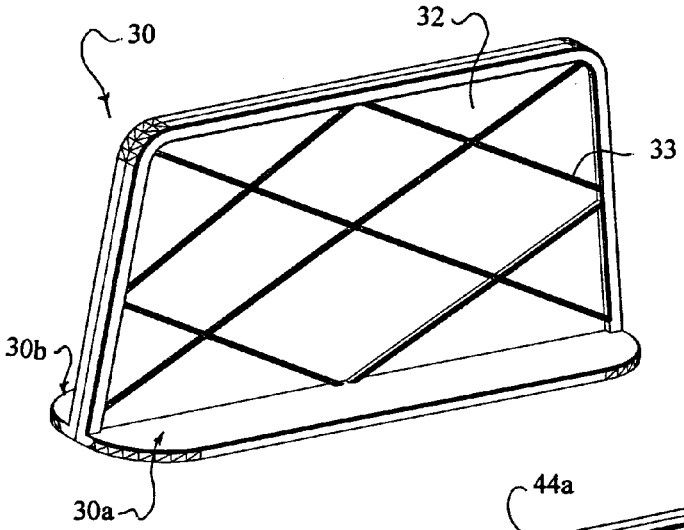
FIG. 18 is an isometric view of barrier-delineator, manufactured in accordance to the invention.

FIG. 18 illustrate an isometric view of another preferred delineator 30, said delineator 30 can be injection molded in one piece with two sides 30*a* and 30*b*, in accordance to the process of the present invention. Delineator 30 has fewer partition walls 33 on each side, thereby allowing the formation of larger reflective cells 32 on both sides 30*a* and 30*b*, of said delineator 30. Each side 30*a* and 30*b* has a planar base surface 35 with recessed grooves.

Figure 19:
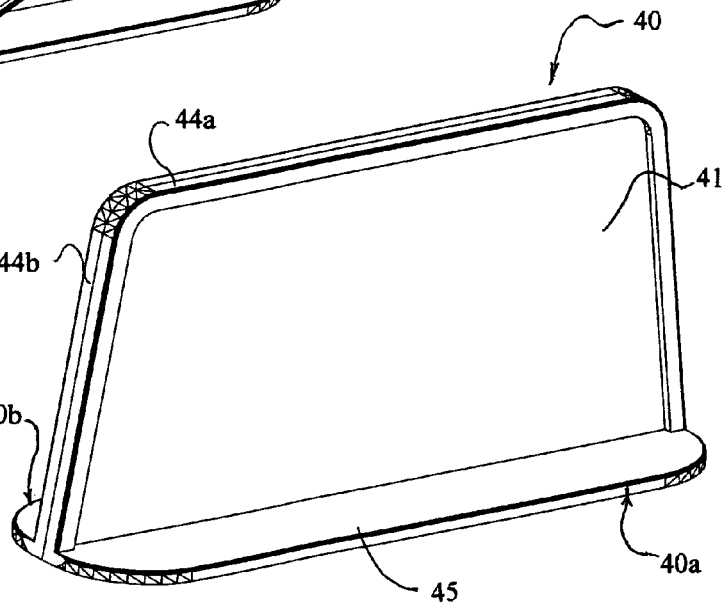
FIG. 19 is isometric view of another barrier-delineator based on the present invention.
Figure 22:
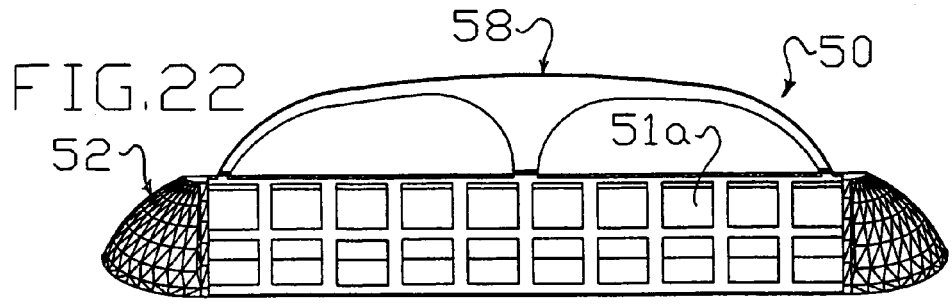
FIG. 22 is an elevation view of the delineator of FIG. 20 showing both top and lower body.

FIG. 19 shows an isometric view of yet another delineator 40, preferably for use on the top or sides of concrete barriers, such barriers are commonly used to separate two directional traffics.

The two sides 40*a* and 40*b* of delineator 40 integrally formed having an interior with multiple cube corner interiors and no interior partition walls and grooved planar base surface 45. By sonically welding the two sides 40*a* and 40*b* at the beaded interior surfaces of the periphery walls 44, thereby delineator 40 is formed.

The various embodiments according to the process of this invention can be provided with means to enhance durability and abrasion resistant of the exterior surface by applying a wear resistant film, by using chemical vapor deposition process for applying a hard carbon film to the reflective face portions of the marker.

The hard film can be either a carbon film, silicon dioxide, aluminum oxide, or aluminum trioxide. In one process which is based on plasma enhanced chemical vapor deposition method, the carbon film is deposited on the surface of the marker by plasma decomposition of an alkane such as normal butane, methane, etc. with two, parallel spaced pure carbon electrodes, each powered by radio frequency power source, in a vacuum deposition chamber.

Under these conditions, the deposition of a very hard carbon film can occur with good adhesion to marker surface.

The deposition of carbon film can be achieved in one or two layers processes within the same evaporative cycle, so that the first layer can have minimum hydrogen content, thereby provide tenaciously adhesion to the substrate surface.

Some belt driven or sequel tools, such as Novellus or Rohwedder AG methods may be available for semi-continuous production coating.

To achieve maximum adhesion of such hard coating, the surface of the marker may be cleaned either chemically or with ion etching prior to applying the carbon film.

Another method in chemical vapor deposition provide means to gradually lowering the hydrogen pressure in the chamber and subsequently reintroducing hydrogen gradually to the plasma decomposition process of a gas, such as argon gas, thereby a buffer film coating of carbon can be attained, immediately followed by a harder carbon film coat with higher hydrogen content thereafter to be deposited on the marker surface.

The present invention includes within its scope a method for making the monolithically formed reflective pavement marker comprising the steps of:

- selecting the pavement marker shape, polymers to be used, type and size of the cube corner reflective elements to be used, body shape, sizes of reflective cells used and the injection molding and agglutination processes to be utilized for said method of making,
- providing a tooling means which allow the injection molding of said reflective pavement marker or delineator, integrally including the cube corner reflective elements in one step, said tooling can be made to mold said marker in one or two compatible material injection molding process either in one or two colors,
- providing the inclined angular position of the partition walls with respect to the planar backside and base surfaces of said pavement marker to allow uninterrupted ejection cycle during the injection molding process of said reflective pavement marker or delineator,
- providing hard resin coating composition, for adding abrasion resistant topcoat on the marker reflective faces, said hard resin coat can be selected from various available, abrasion resistant coating resins, said hard resin composition can be dip coated, sprayed or brushed on said faces,
- providing an opaque color additive to be added to a selected hard abrasion resistant resin composition for coating the remaining portions of the marker outside surfaces, this hard, colored topcoat will provide the same abrasive resistant, durable surface. One color or two opaque color segments can be applied to the body of the marker, said resin coating composition is selected from a variety of available abrasion resistant coating resin.

It is understood that various changes or modifications can be made within the scope of the appended claims to the above-preferred method of forming one-piece reflective marker without departing from the scope and the spirit of the invention. The principle processes of this invention are not limited to the particular embodiments described herein. Various embodiments can employ the processes of this invention. This invention is not limited to the exact method illustrated and described; alternative methods can be used to form the intended monolithically formed reflective pavement marker of this invention.

What is claimed is:

1. A one piece reflective roadway marker comprising:

an upper resilient segment having an interior planar surface with raised, beaded periphery edges and a plurality of cube-corner reflective elements;

a lower rigid body segment having a top planar portion, one inclined reflective face, two arcuate sides, a planar base surface and a backside forming a perpendicular angle with respect to said base surface, said backside can be provided with thin ties for interlocking with the backside of a second marker;

a plurality of cube corner reflective elements within the interior of designated cell like areas within said inclined reflective face of the lower rigid body segment; and a plurality of walls for partition and structural support within said lower rigid body segment, said walls disposed rearward starting at the periphery of said designated interior cell like surfaces of the reflective face, thereby defining multiple hollow cavity air gaps beneath said cube corner reflective elements, said hollow cavity air gaps each having a centerline that form an angle of about 80 to 120 degrees with respect to the corresponding outside planar reflective face, said hollow cavity air gaps having one row of open ends at the planar base surface and an upper row of open ends at the vertical backside of said lower body.

2. The one-piece reflective roadway marker of claim 1, wherein two of said one-piece roadway markers are agglutinated at the upper beaded periphery edges and the lower vertical backsides, thereby forming a two-way reflective roadway marker, said upper resilient segment integrally tied to said lower body with thin portions that can be tearable from said body, thereby retaining said lower body segment adherent to the pavement as permanent reflective marker.

3. The one-piece reflective roadway marker of claim 1, wherein said open ends of hollow cavity air gaps within the planar base surface can be sealed with a compatible polymeric capping sheet, wherein a pressure sensitive adhesive pad can be applied to secure said reflective marker to the roadway surface.

4. The one piece reflective roadway marker of claim 1, wherein the outside surface of the reflective face can receive an abrasion resistant resinous coating composition.

5. The one piece reflective roadway marker of claim 1, wherein an opaque color additive can be added to a hard abrasion resistant resin composition for coating the body portions of said reflective roadway marker outside surfaces, said hard colored topcoat provides an abrasive resistant and durable surface, said outside surfaces having one color or two opaque color segments.

* * * * *